US006453709B2

(12) United States Patent
Leroux et al.

(10) Patent No.: US 6,453,709 B2
(45) Date of Patent: Sep. 24, 2002

(54) COLD ROLLING METHOD AND INSTALLATION

(75) Inventors: Francois Leroux, Senlis; Marc Valence, Courbevoie, both of (FR)

(73) Assignee: Vai Clecim, Nanterre cedex (FR)

( * ) Notice: Subject to any disclaimer, the term of this patent is extended or adjusted under 35 U.S.C. 154(b) by 0 days.

(21) Appl. No.: 09/839,246

(22) Filed: Apr. 23, 2001

(30) Foreign Application Priority Data

Apr. 21, 2000 (FR) ..... 00 05186

(51) Int. Cl.[7] ..... B21B 45/04
(52) U.S. Cl. ..... 72/39; 72/203; 72/365.2
(58) Field of Search ..... 72/39, 203, 205, 72/206, 236, 365.2; 29/33 Q, 81.01, 527.4; 148/610; 134/3, 41

(56) References Cited

U.S. PATENT DOCUMENTS 3,536,601 A 10/1970 Hill et al.
3,918,282 A 11/1975 Eibe
4,188,812 A * 2/1980 Nomura et al. ..... 72/227
4,872,245 A 10/1989 Kawasaki et al.
5,061,321 A * 10/1991 Nishimoto et al. ..... 134/3
5,197,179 A * 3/1993 Sendzimir et al. ..... 29/527.4
5,279,141 A * 1/1994 Kenmochi et al. ..... 72/39
5,463,801 A * 11/1995 Kajiwara et al. ..... 29/33 Q
5,800,694 A 9/1998 Starcevic et al.
5,820,704 A 10/1998 Veyer et al.
5,826,818 A * 10/1998 Douaud ..... 72/231
5,992,196 A * 11/1999 Giraud et al. ..... 72/39
6,068,001 A * 5/2000 Pedrazzini et al. ..... 134/3

FOREIGN PATENT DOCUMENTS

EP 0 723 024 A1 7/1996

* cited by examiner

*Primary Examiner*—Ed Tolan
(74) *Attorney, Agent, or Firm*—Arent Fox Kintner Plotkin & Kahn

(57) ABSTRACT

The invention relates to a method for rolling a metal band in a continuous line installation with coupling of the pickling and cold rolling processes. According to the invention, the composition of the pickling fluid is determined to allow the running of the band in the bath at a minimum speed of a few metres per minute, and similar running speeds are maintained in the pickling and rolling sections, during the operating phases, whereas the rolling conditions are determined in order to maintain the requested quality of the band at a minimum rolling speed that may be as low as 1 metre per minute.

20 Claims, 3 Drawing Sheets

COLD ROLLING METHOD AND INSTALLATION

The invention relates to a cold-rolling method and installation for a metal band, especially suited for an average yearly production, for example ranging between 300,000 and one million tons.

The invention applies in particular to descaling and rolling steel sheets and strips obtained by hot rolling or by thin continuous casting.

It is known that generally, the manufacture of metal products calls, first of all, for the preparation of a raw product by ingot mould casting or continuous casting, hot transformation by forging and/or hot rolling and cold transformation comprising various steps that depend on the nature of the metal, for example ferritic or austenitic steel, and on the product to be manufactured, for instance ordinary steel, stainless steel, alloyed steel.

Usually, the hot prepared product is subject, successively, to a descaling treatment for descaling, to cold rolling until the requested thickness is obtained and, possibly, to finishing treatments that depend on the type of sheet to be produced, for example annealed, galvanised or other surface treatment.

Cold rolling is conducted, normally, in several successive passes, either in two opposite directions on a reversible mill, or on several rolling stands operating in tandem.

Up to recently, the various cold treatments had always been carried out in a discontinuous fashion in different installations, whereas the product is wrapped into a coil at the end of each step in order to be transferred to the next step. These non-continuous methods therefore require several unwinding and winding operations of coils as well as intermediate storing phases generating significant costs, taking into account the necessary handling tools and staff.

Moreover, in reversible rolling, a minimum band length must remain wound on each coil and is therefore not rolled. These parts outside tolerances cannot be marketed and must hence be eliminated.

To remedy these shortcomings, the last few years have seen the development of continuous line manufacturing methods that enable doing away with coil winding at least for certain intermediate steps. In particular, we already know methods in which certain cold transformation operations are carried out continuously on a single line. For example, coupling pickling with cold rolling enables reducing, to a vast extent, the shortcomings stated above.

A coupled line installation of this type comprises, generally, an inlet section containing a device for unwinding, one after the other, coils to be treated, a pickling section for descaling, generally by immersing the band in a chemical pickling liquid, a cold rolling section and an outlet section comprising means for winding the rolled band into a coil.

To perform continuous running of the band, the inlet section comprises linking means, by welding or stapling, of the downstream extremity, in the running direction, of a first coil with the upstream extremity of the following coil. Thus, we obtain a continuous band running successively through the different sections of the line.

In normal operation, a same running speed, for example 400 m/min or even more, is maintained up to the inlet of the mill and increases then in relation to the reduction in thickness.

However, for various reasons, it is necessary to vary considerably the speed of a section with respect to the adjacent sections, respectively upstream and downstream.

For example, during the time necessary to the connection of extremities of two successive coils, the inlet section is stopped, whereas the band must still be running in the pickling section whose stoppage might cause defects on the metal further to an excessive dwelling in the acid used.

Similarly, it is required, in some cases, to stop or, at least, to slow down the running in the rolling mills, for example for maintenance operations. Indeed, the working rolls are worn quite rapidly and must be replaced periodically with new rolls. During the time necessary to replacement, the rolls are held away from the band and, even if the running of the band is not stopped completely, it should be at least slowed down in order to reduce the length of the band that has not been rolled, which then should be eliminated.

On the other hand, after rolling, the band is wound once more in order to form a coil and, when the said band reaches its maximum length, the band must be shorn to allow evacuation of the wound coil. To avoid complete stoppage of the band during shearing, it is advantageous to use so-called 'flying' shears composed of two blades mounted respectively on two rotating drums, but the speed must, however be reduced.

After shearing, the band must be wound to the end and the complete coil must be evacuated, then the shorn extremity of the following band must be attached to the reeling plant in order to constitute a new coil To do so, two coilers operating alternately may be used, with a switching system that enables, after shearing, to direct the upstream extremity of the following band immediately to the second coiler for winding the new coil, whereas retraction of the wound coil on the first coiler is performed in hidden time. A so-called carousel coiler comprising two winding mandrels operating alternately can also be used.

These arrangements enable reducing the time necessary to changing the coil, but the shorn band should run forward at low enough speed to enable its extremity to engage on the chuck and to start the winding process.

It seems therefore that even if perfected arrangements enable to reduce the time necessary to certain operating phases during which the running speeds in the different sections of the line must vary independently from one another, it is necessary to place means for accumulating the band between certain sections. Thus, the band can be accumulated at the outlet of a section when the running is stopped or slowed down downstream and, conversely, when the running is stopped or slowed down in a section, it is possible to continue running, downstream, a band length accumulated previously.

Generally, such a coupled line must comprise at least two means of accumulation placed, respectively, at the inlet and at the outlet of the handling section. Thus, before reaching the end of a coil, a certain length of the band will be accumulated, which will continue to run in the handling section for the time necessary to the connection with the extremity of the following coil. Similarly, if the mill has been stopped, for example for replacing the rolls, the band should be run further in the pickling tanks, while accumulating the pickled length at the outlet of the treatment section.

Obviously, other members are necessary such as tensioning devices for traction load adjustments in the different sections or edge shears.

All these members are obviously quite expensive and call for high energy expenses and maintenance costs.

Indeed, to ensure the necessary high running speeds, the control motors of the various pieces of equipment must be very powerful.

Moreover, after usage, the inlet accumulator of the treatment section must be emptied in order to compensate for later speed variations.

Still, these operations must be carried out very rapidly in order to reduce the transition periods and require therefore motors capable of supplying the necessary accelerations.

Besides, in order to maximise the operation of the mill, the said mill must be suited to certain types of products and the other sections of the line, in particular pickling and finishing sections, must be provided accordingly.

Therefore, although such installations are extremely costly, their operating conditions must paradoxically be sufficiently rigid to ensure profitable production with the quality requested.

Because of the investment costs, the energy expenses and the maintenance costs, such coupled installations had been provided so far only for high production levels, ranging for example between 1 and 2 million tons per annum, if not more. Such capacities are, obviously, justified only for certain types of products and, in other cases, it seems more economical to use conventional installations in which the operations are carried out separately and discontinuously. In particular, for average productions, cold rolling is, normally, conducted in a reversible mill, by successive passes in one direction and in the other.

However, as it is not possible to obtain the same advantages as in a coupled line, such as the suppression of intermediate stocks, diminution of staff requirements, reduction in the surface covered or diminution of band lengths outside tolerance, such discontinuous installations are only profitable for special products such as stainless steels, up to 300,000 or 400,000 tons, or in the case of mini factories producing varied sheet qualities, but in limited quantities.

Conversely, there had not been, so far, average capacity installations, for example between 300,000 and one million tons and enabling economic production of sheet metals of all types.

To solve such a problem, the invention concerns a new method for producing metal bands in a coupled line that enables to reduce the investment and operating costs sufficiently to remain profitable even for an average production, between 300,000 and one million tons.

The invention applies therefore to a coupled line installation comprising as usual, an inlet section of the treatment band, a cold rolling section and an outlet section.

According to the invention, the composition of the treatment fluid is determined so that the metal of the band is not attacked during a dwelling period in the treatment section corresponding to a minimum running speed in the order of a few metres per minute, and the rolling conditions are determined so that the requested qualities of the band can be maintained at minimum rolling speed that may be as low as one meter per minute.

Thus, the running speeds, respectively in the treatment section and in the rolling section remain substantially similar throughout the operating phases, and it is possible to considerably reduce the capacity of the accumulators and, consequently, the investment and operating costs.

Indeed, as stated above, the coupled lines used until now have a very large capacity, exceeding for example, 150,000 tons per month and hence work at very high speed.

Moreover, the mill must be able to realise a significant thickness reduction ratio and usually comprises four or five stands operating in tandem. This leads to significant running speed variations in the line.

For example, the average rolling speed of the band may range between 500 and 1,500 m/mn at the outlet of the rolling section whereas the running speed in the pickling section must necessarily remain lower, for example between 100 and 400 m/mn.

Therefore, in the conventional coupled lines, the accumulators must have a very large capacity, in the order of 400 to 600 m for compensating the necessary speed variations between the different sections, and thus constitute extremely cumbersome and complex installations, comprising several running levels of the band between a series of fixed deflecting rolls and a series of mobile rolls that may move longitudinally to vary the lengths of the different levels.

Normally, the production capacity of an installation, at equal width and thickness, is proportional to the running speed and as the necessary stoppage times of the band, at the inlet and at the outlet of the line, are the same, the capacity to confer the accumulators is more or less proportional to the tonnage to be realised. Consequently, for an installation producing 400,000 tons per annum, i.e. approx. 20% of the capacity of the current coupled lines, the capacity of the accumulators should normally be reduced in the same proportion, which leads to a sizing from 80 m to 120 m. Such accumulators are still very cumbersome and expensive and, for this reason notably, it has not appeared possible so far to make a coupled line profitable for an annual production smaller than 1 million tons.

In order to solve this problem, the inventor has deviated from the usual operating conditions while selecting, on the contrary, to conduct the operations so that it should be possible, while maintaining the desired quality of the band, to use simple and cheap equipment enabling to lower the investment, operating and maintenance costs sufficiently so that such a coupled line is profitable even for average capacities.

To this aim, in a particularly advantageous fashion, during all the operating phases, the relative running speeds, respectively in the inlet section, the treatment section, the rolling section and the outlet section, are adjusted so that the speed difference between two successive sections during an operating phase matches the running, in the fastest section, of an additional band length not exceeding a few ten metres.

Thus, whereas in conventional coupled lines, the band accumulators are very large installations with a complex operation, the invention enables using accumulators with reduced capacity, for example a few ten metres, and with a far simpler constitution.

On the other hand, as can be seen in the following detailed description, the other members of the installation can also be simplified while preserving the qualities of the band produced.

In particular, the running speeds may be reduced considerably, even in the rolling section, and it is therefore possible, at the outlet of the said rolling section, to use fixed type shears cutting the band at a speed not exceeding one metre per minute, as well as winding means comprising a single reeling plant.

Besides, thanks to the possibility of maintaining the quality of the band, even at low speed, it is not necessary to reduce the filling time of the accumulators to the maximum. Consequently, the maximum running speeds, respectively in the inlet section and in the rolling section need not exceed by more than 10% the maximum running speed in the treatment section. Under these conditions, the accelerations may be reduced. Thus, smaller and, consequently, cheaper motors can be used.

As a result, the investment and maintenance costs of a coupled line according to the invention are reduced considerably with respect to those of a conventional coupled line, with very high capacity. On the other hand, as rolling can be prolonged up to very low speed, the yield ratio remains acceptable. It is then possible to produce economically cold rolled coils with an average capacity ranging between 300, 000 and one million tons.

Thanks to the advantages provided by the coupling, an installation according to the invention remains profitable even for the production of ordinary quality sheets or strips, for instance in low alloy steel, and will have therefore quite a varied production range whereas, until now, the coupled lines had only been used for certain qualities justifying a high production capacity.

It has been noted, on the other hand, that the capacity foreseen for an installation according to the invention corresponded more or less to the capacity of a continuous lining or annealing line. Consequently, it will be possible to combine an installation according to the invention with other facilities placed downstream the rolling section and enabling to subject the band to various finishing treatments, according to the requested quality. Indeed, the operation of a coupled line with average capacity according to the invention exhibits sufficient flexibility to enable incorporation of a lining with annealing equipment, for example, a galvanisation line, to the same line.

Other advantageous features of the invention are covered by sub-claims. But the invention will be understood better by the following description of certain embodiments of a coupled line, given for exemplification purposes and illustrated by the appended drawings.

Figure 1:
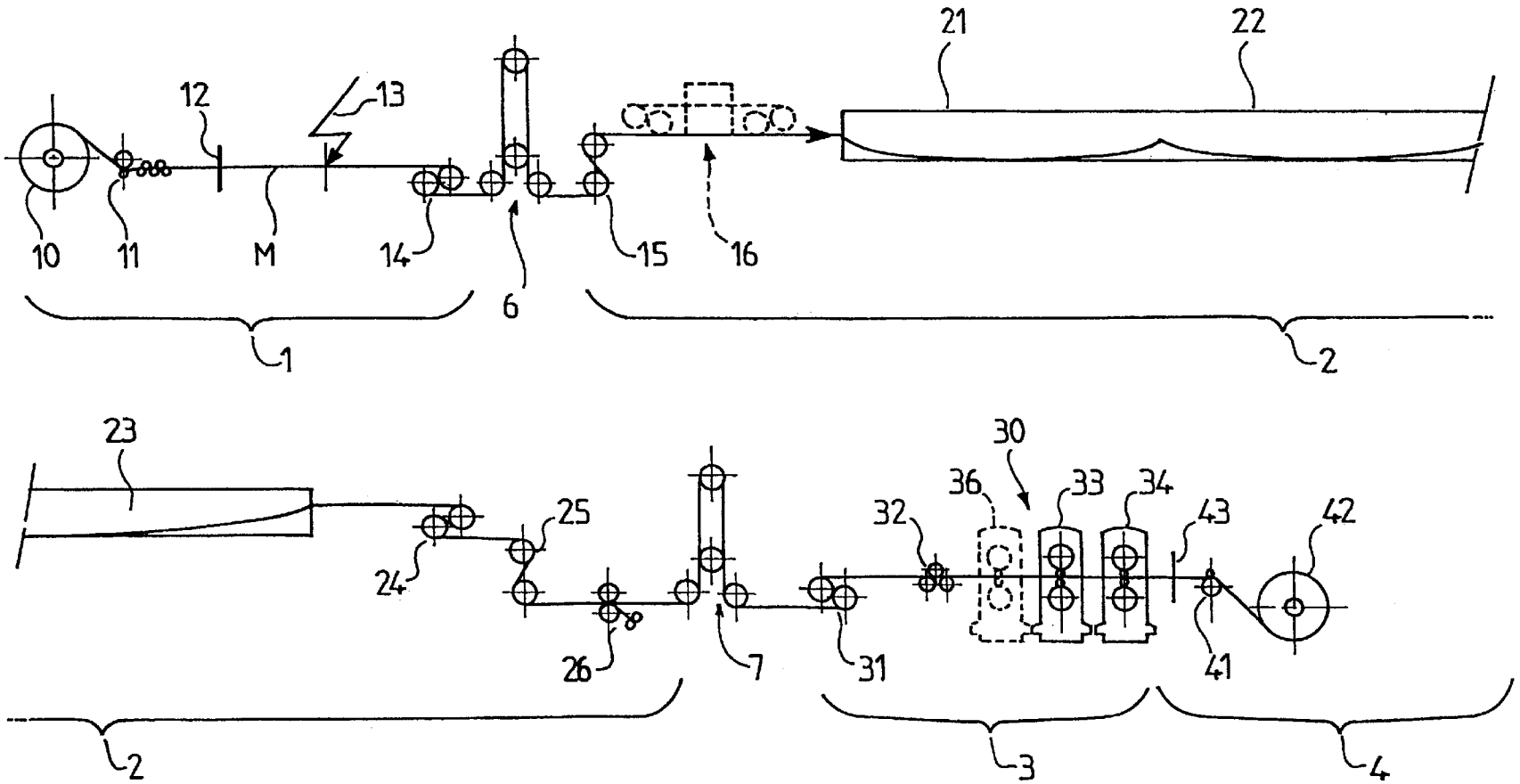
FIG. 1 is an assembly diagram of a coupled line installation according to the invention.

FIG. 1 represents diagrammatically a coupled line according to the invention comprising in succession, along a longitudinal running direction of the metal bands, an inlet section 1 of the band, a treatment section 2, a cold rolling section 3 and an outlet section 4.

As usual, the inlet and preparation section 1 of the band M comprises a coil unwinder 10, a device 11 for straightening and unbending the band, cropping shears 12 and a welding device 13. Indeed, once a coil has unwound completely, a new coil should be placed on the unwinder 10 and the head of this new coil connected to the tail of the preceding coil to ensure continuous treatment over the whole line. To enable the connection of both coils, the extremities are first cropped by the shears 12 in order to realise two parallel edges that are welded in the welder 13. This welding can be carried out by any appropriate means. The shears 12 and the welding machine 13 can be grouped into a single machine.

The band then runs through a treatment section 2 that is usually composed of several tanks 21, 22, 23 whose number and length are determined in relation to the hourly tonnage requested and to the running speed foreseen. Inside each tank, the band is immersed in a chemical pickling fluid, for example hydrochloride acid, whose composition is determined to ensure complete elimination of the scale taking into account the dwelling time of the band in acid, which depends on the running speed. To promote the action of the acid, scale can be fractionated mechanically, for example by shotblasting.

In a known fashion, the pickling section is provided at its end with an edge shearing facility 26 for products requiring width adjustment in this production line. Upstream the edge shears lies a band guiding device 25 enabling good centring of the band and adjustment of its width with minimum loss of metal.

The cold rolling section 3 comprises a mill 30 in front of which is placed a traction device 31 to subject the band, during rolling, to a controlled traction load. The mill 30 is composed, normally, of several roll stands 33, 34 operating in tandem, but it should be noted that, in the invention, the mil may comprise only two stands 33, 34. At the inlet of the mill 30, a band guiding device 32 enables centring the band and ensuring its correct running between the working rolls.

The rolled band passes finally through an outlet section 4 comprising a reeling plant 42 in front of which is placed a deflecting roll 41. The reeling plant 42 comprises a mandrel driven into rotation round its axis and on which the extremity of the band to be wound engages.

When the coil wound at the outlet reaches a pre-set weight, the band must be shorn and the completed coil evacuated in order to start winding a new coil. To this end, shears 43 are provided on the path of the band upstream the deflecting roll 41 and the reeling plant 42 is connected to means, not represented, for evacuating the coils and to means for engaging the extremity of the following coil on the mandrel of the reeling plant.

As stated above, to connect together the extremities of two successive coils in the welding machine 13, both bands to be welded should be stopped in the inlet section 1, but normally, the band must continue to run in the treatment section 2 so that the dwelling time of the band in the acid is not too long. To do so, it is necessary to place, at the inlet of the treatment section 2 a band accumulator 6 which is pre-loaded with a certain band length and enables to continue the running of the band through the tanks 21, 22 during the time necessary to welding the extremities of both coils, in the inlet section 1.

Similarly, the rolling process is stopped at least during the time necessary to replacing the rolls in the stands 33, 34 whereas the band should still be running in the tanks 21, 22 to avoid excessive attack by the acid. It is possible to extend the running of the band between the working rolls that are then spaced apart, but this produces a certain length outside the tolerances, which must be eliminated, and thereby increases the yield ratio of the installation. Therefore, a second band accumulator 7 should be placed after the outlet of the treatment section 2, to enable stopping or slowing the band down in the rolling section 3, to allow the band to run further in the treatment section 2 while setting aside the band length etched in that fashion, which will then be rolled up to the thickness requested.

Obviously, other members may, in relation to the needs, be placed on the path of the band. For example, in order to maintain the necessary traction loads in the different sections of the line, the said line comprises several tensioning devices, respectively, 14 at the inlet of the first accumulator 6, 24 at the outlet of the pickling section 2 and 31 at the inlet of the rolling section 3. A guiding device 15 is placed at the inlet of the first pickling tank 21 to compensate for the geometrical defects of the band while maintaining the said band on the running axis, over the whole length of the tanks 21, 22 and 23.

On the other hand, the pickling section 2 is terminated, as usual, by an edge shearing facility 26 for products requiring width adjustment in this production line and a band guiding device 25 is mounted upstream the edge shears to ensure good centring of the band and adjustment of its width with minimum loss of metal.

A tensioning device 31 is placed at the inlet of the rolling section 3 in order to isolate the traction level of the second band accumulator 7, which is relatively low, from the traction level of the rolling section that must be high enough at the inlet of the mill 30 to allow the necessary reduction ratio on the first stand. A band guiding device 32 is also placed at the inlet of the mill 30 to ensure good running of the band up to the winding section 4.

An installation according to the invention comprises therefore, in its different sections, the facilities that are usually encountered in coupled lines but, as can be seen now, the operations are conducted in order to simplify the whole installation.

To do so, it has been observed, first of all, that the operating conditions of the pickling installations had evolved. Indeed, it is now possible to use addition products having an inhibiting effect on the acid contained in the tanks so that the said acid attacks the scale solely and remains harmless on the metal of the band. Such products have been developed recently to enable, in case of emergency, a rather extended stoppage of the band in the tanks, for example, if a failure of the roll requires the said roll to be stopped for a duration longer than the capacity of the accumulator placed at the outlet of the treatment section. In such a case, it was necessary, previously, to purge the acid in order to prevent the metal from being attacked and there was a great waste of time and of production, let alone the risks of pollution. To avoid this purge, it is possible to add the inhibitor in advance to the treatment bath that allows to maintain the band in the acid for a certain time without risking any loss of metal.

However, in any case, such inhibitors were only useful in case of emergency.

In the invention, conversely, the inhibiting product(s) added to the treatment bath are used in normal operating conditions and during each coil winding cycle, to allow reduction of the running speed in the treatment section down a speed of a few ten metres per minute, whereas the minimum speed may even be 1 to 2 metres per minute, each time the band must be stopped or slowed down, upstream or downstream the treatment section. The presence of the inhibiting product(s) in the treatment bath enables, indeed, quite a long dwelling time of the band in the pickling tanks without risking any loss of metal, whereas only scale is attacked.

Thus, when the band is stopped in the inlet section during the connection phase of both bands to the welding machine 13, it is not necessary any longer to have a great band length accumulated in the first accumulator 6 to continue running in the treatment section 2. Conversely, thanks to the inhibitors, it is possible to reduce the running speed in the tanks, for example down to 5 m/mn. If the welding time is, for example 2 mn, an accumulation capacity in the order of 10 m of the band is then sufficient. Similarly, if the running speed in the pickling section is reduced, according to the invention, down to a speed in the order of 1 to 2 m/mn, a 10 m-accumulation capacity in the second accumulator 7 placed downstream the treatment section 2 enables to stop the roll for 5 to 10 mn, for example for the evacuation of a coil from the reeling plant 42.

But, according to another feature of the invention, the running speed in the roll can also be reduced.

It has been noted, indeed, that various improvements made recently to the design of the rolls in order to enhance the quality of the rolled sheet, could maintain the quality of the band down to a very low rolling speed.

Indeed, the roll stands for example of the quarto type, can be fitted with means for controlling the surface evenness by cambering the working rolls and/or by using back-up rolls with a revolving shell and with controlled deformation of the type realised by the applicant company and known under the name 'DSR' (trademark).

We also know so-called 'Z-high' sexto type roll mills, in which lateral supports enable the use of very small diameter working rolls.

More and more, by reasons of the increasing quality requirements expressed by the clientele, modern mills are fitted with such means for controlling surface evenness and it has been discovered that the use of these means and the adaptation of the diameter of the rolls to the features of the product to be rolled would enable reduction of the rolling speed while preserving the quality of the product. Still, for very low rolling speeds, the mill load at equal reduction ratio increases, but this effect can be compensated for by a smaller diameter of the working rolls. Moreover, a judicious choice of the lubricant enables sufficient lubrication while avoiding the slipping effect that could be feared by reasons of the small diameter of the rolls.

Thus, whereas until it appeared necessary to maintain a minimum rolling speed in the order of 100 m/mn during the cutting process, it will be possible in the installation according to the invention, to reduce the rolling speed down to a few metres per minute, without losing the quality of the band and the thickness tolerances.

To do so, the working rolls have a diameter suited to the type of production, whereas the mill 30 is fitted with means for changing and replacing the rolls.

In practice, installations with two diameter ranges for the working rolls are conceivable, according to the features of the products to be rolled:

- a range in the order of 350 mm diameter to produce sheets made of steel with low elastic limit and whose minimum thickness would be 0.5 mm.
- a range in the order of 150 mm diameter to produce sheets made of steel with higher elastic limit, down to a minimum thickness in the order of 0.35 mm.

Thanks to these arrangements, it will be possible to guarantee the quality of the band over a range of very low speeds, without increasing the production of 'outside tolerance' lengths.

Thus, in the method according to the invention, it is possible in all the operating phases, to maintain a small difference in the running speeds between the different sections of the line.

During stoppage, for welding purposes, in the inlet section 1, the running speed can be reduced to a few metres per minute, not only in the pickling section 2, but also in the rolling section 3, without stopping the rolling process.

Similarly, during the stoppage time of the mill 30 for shearing the band at the end of a coil and evacuating the said coil, the running of the band in the treatment section can be stopped or, at least, slowed down to very low speed.

Accumulators with small capacity, in the order of a few ten metres, are therefore sufficient in all the operating phases. Such accumulators can be realised very cheaply and are little cumbersome. For example, as represented on FIG. 1, the accumulators 6 and 7 may be of two-belt vertical type with a vertically mobile deflecting roll.

Such an accumulator 7 also enables to stop, for a few minutes, the running of the band in the pickling section 2, for example for adjusting the edge shears 26, while proceeding with the high speed rolling.

Besides, in conventional coupled lines, the control motors of the various facilities must be very powerful to enable very significant speed variations with high acceleration ratios in order to go through the transition stages as quickly as possible. Indeed, the loss of certain quality parameters of the band produced should be avoided and the time during which the length of the band lies outside the tolerances should be minimised.

Conversely, in the method according to the invention, the different sections operate permanently over a speed range between 0 and 100 metres per minute and these speeds remain in the same order in all the different sections and in all the operating phases. Consequently, after a slowing down phase, it is not necessary to come back very quickly to the normal running speed since the speeds in all the sections can be increased gradually, with an average acceleration ratio. Therefore motors less powerful than in conventional installations can be used and, thus, the investment cost and the energy expenses are considerably reduced.

For example, in a conventional installation, after a stoppage time of the inlet section for the connection of two coils, the inlet running speed is usually increased up to two or three times the speed in the pickling section in order to fill up the first accumulator quickly. In an installation according to the invention, conversely, since during the stoppage, the running speed in the pickling section and in the rolling section was only a few metres per minute, the mill gradually comes back to the normal running speed, in all the sections. To fill up the accumulator that has, anyway, a small capacity, it suffices to let the band run in the inlet section at a speed not exceeding by more than 10% the speed in the pickling section 2.

Thus, for a pickling speed, for example 50 m/mn, a 10% speed increase, i.e. up to 55 m/mn, will enable to fill up the accumulator 6 in approximately two minutes, which is quite compatible with the unwinding time of a coil that is about 10 minutes for a 50 m/mn treatment speed and for a coil to be rolled with a wound length of approximately 500 m.

The possibility, according to the invention, of maintaining the rolling process down to a very low speed, but not a zero speed, for example in the order of 1 m/mn, enables, at the outlet of the roll mill 30, to cut the band as it is running slowly, by means of 'fixed' type shears. Such shears are, obviously, much cheaper than flying shears of the type used normally, in high production coupled lines, in order to shear the band without stopping the rolling process.

Conversely, the possibility of cutting during slow running enables doing without any stoppage of the mill, which might leave marks on the rolled product, and of winding the coil to an end, which can then be evacuated before the new band head formed by cutting reaches the engaging device on the coiler 42, for the formation of a new coil. This possibility of using a single coiler also constitutes a very significant economy with respect to conventional lines in which two coilers with switching devices or a single coiler with carousel should be used, whereas such facilities are much more expensive.

Obviously, because of the roll speed reduction and of the limited power of the control motors, it is not intended, in a coupled line according to the invention, to realise the same thickness reductions as in high power lines where a four or five stand tandem mill is used with a minimum speed of 500 m/mn.

But, precisely, certain types of products, which correspond to average production capacities, only call for 50 to 75% thickness reductions, which can be performed in two passes, if working rolls with suitable diameter are used.

Consequently, a coupled line according to the invention could be simplified further by using a mill 30 comprising, normally, only two stands 33, 34.

The invention therefore enables reduction of the investment and operating costs of the coupled line practically in all the sections of the said line and thus such an installation can be profitable even for average production capacities.

Still, the production possibilities of such a simplified line are not the same as those of the coupled lines known until now, but they remain sufficient, however, to justify the profitability of an installation according to the invention.

In particular, thanks to recent technical evolutions, there are now improved hot rolling facilities or continuous thin casting installations that enable production of hot bands with minimum thickness of 1.5 mm for example. From so thin incoming products, an average reduction ratio, for example ranging from 50 to 60%, which can be obtained in two roll passes, enables manufacture of marketable products, for instance down to a minimum thickness of 0.5 mm.

Figure 2:
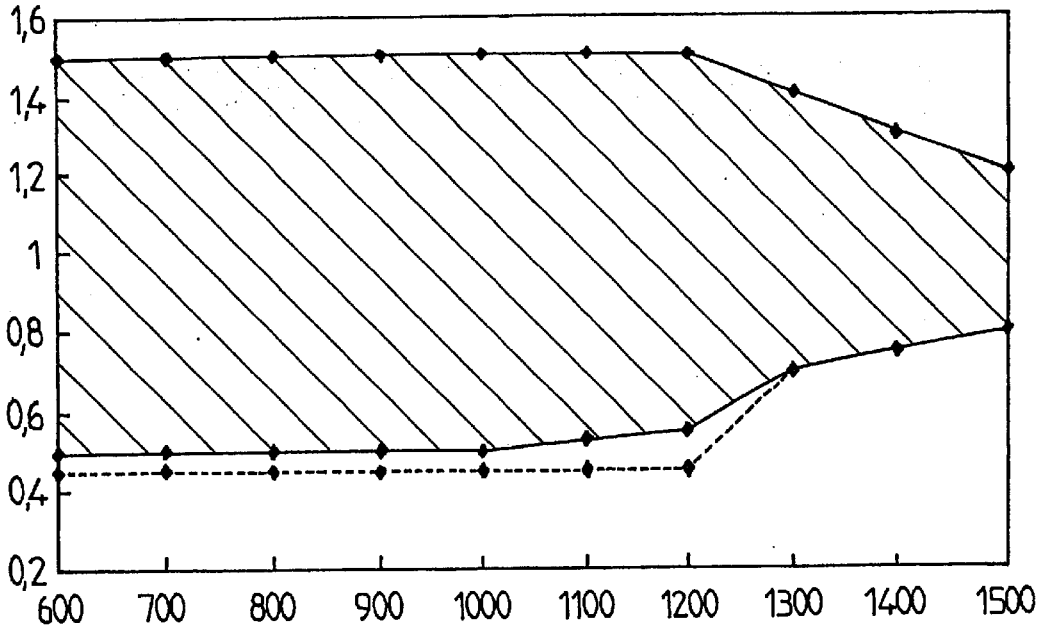
FIG. 2 is a diagram illustrating the manufacturing capacity of an installation according to the invention, with a roll stand fitted with 320 mm-diameter working rolls.
Figure 3:
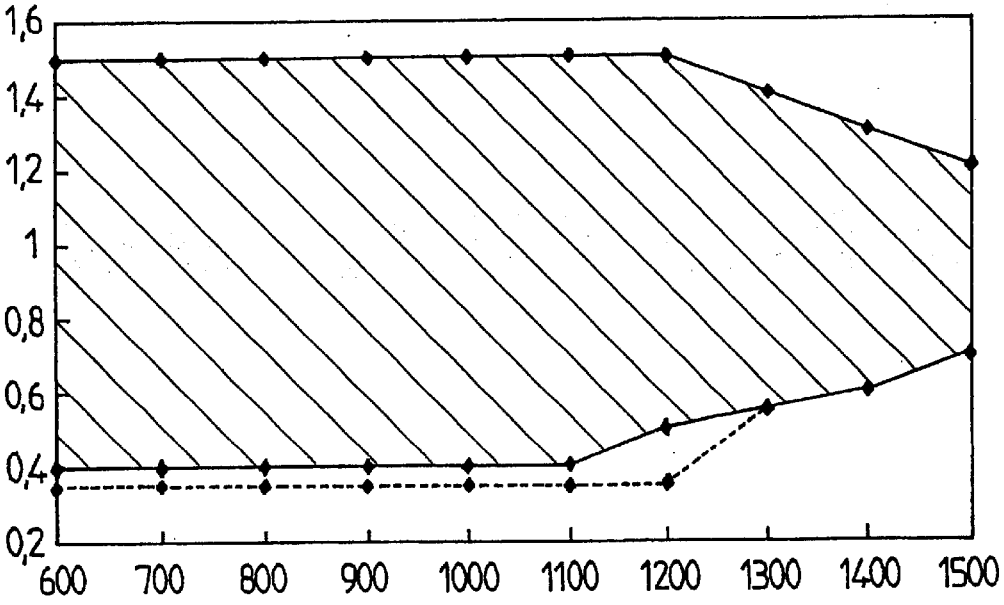
FIG. 3 is a diagram representing the manufacturing capacity of an installation according to the invention with a roll stand fitted with 140 mm-diameter working rolls.

For exemplification purposes, the diagrams of FIGS. 2 and 3 specify the production fields of a coupled line according to the invention comprising a two stand mill, whereas both stand can be fitted with two types of working rolls.

Each diagram indicates, in ordinate, the thicknesses that can be obtained at the outlet of the installation for various band widths specified in abscissa.

For a production of rolled steel with small elastic limit and down to a minimum thickness of 0.5–0.6 mm, the mill 30 is fitted with a working roll having a diameter in the order of 320 mm. On FIG. 2, the hatched zone indicates the production range of such an installation per thickness and per product width, while considering that the incoming product, delivered by a conventional hot rolling facility or a continuous thin casting installation, exhibits a thickness in the order of 1.5 mm. With a 50 to 64% reduction ratio, it is possible to produce all the thicknesses between 0.5 and 1.5 mm up to a band width of approximately 1100 mm. However, as the power of the motors has been limited in the example of FIG. 2, the thickness range is narrower for the widths above 1100 mm, whereas the outlet thickness ranges between 0.7 and 1.1 mm for a maximum width of 1500 mm.

For minimum thicknesses, the lower continuous line matches the use of shotblasted working rolls that wear rather quickly.

With smooth rolls, a 68% reduction ratio can be reached, at least for widths smaller than 1200 mm, as shown by the lower dotted line.

For a production of rolled steel with higher elastic limit or in a lower thickness range, possibly as low as 0.35 mm, it is preferable to use working rolls with a diameter in the order of 140 mm. FIG. 3 illustrates the possible production range with such an installation and for an incoming product whose minimum thickness is 1.5 mm.

It can be seen that the production range still remains relatively wide, whereas a 56 to 73% thickness reduction is possible up to a width of approximately 1100 mm. With smooth rolls, a 77% thickness reduction ratio can be reached.

Obviously, it is only for exemplification purposes that we have described an installation according to the invention, whereas the said invention can be subject to variations without departing from the protection scope delineated by the claims.

For example, it is possible to use treatment or rolling facilities of any known type, providing that they allow to obtain the requested quality at low running speeds and with reduced investment costs. It should be noted that, as the mill comprises no more than three stands, the said stands may be fitted with evenness monitoring facilities, such as controlled deformation back-up rolls, or they may be of Z-high type.

Such facilities are, indeed, profitable even for an average production, by reasons of the advantages brought by coupling.

Consequently, it will be possible to increase the production of an installation according to the invention already realised by adding an oxide-breaking device 16 enabling to increase the pickling capacity, or a third stand 36 in the rolling section. We could also increase the annual production of such an installation by approximately 50% and raise the capacity from 400,000 to 600,000 tons yearly, while keeping the advantages of such a line as regards the investment and operating costs.

On the other hand, a coupled line according to the invention could, in a particularly advantageous fashion, be completed, before winding the band into a coil, with one or several additional sections enabling to realise finishing treatments, according to the requested quality.

It has been observed, indeed, that the average capacity of 300,000 to 700,000 tons, foreseen for an installation according to the invention, as well as the possibility of varying, in a very flexible manner, the running speed in the different sections are particularly compatible with the operating conditions of the lining and/or continuous annealing lines.

Figure 4:
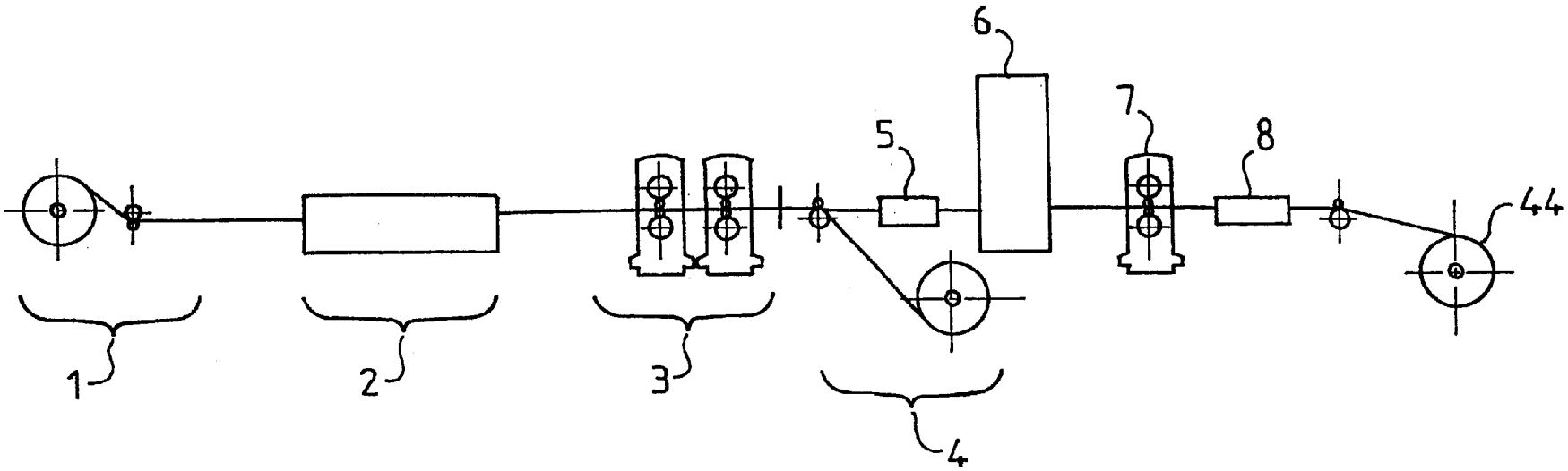
FIG. 4 is an assembly diagram of an installation according to the invention associated with pieces of equipment intended for certain finishing treatments.

FIG. 4 is therefore a diagrammatical representation of such an improved installation comprising, as previously, an inlet section 1, a treatment section 2 and a rolling section 3 and completed, downstream the latter, with finishing facilities, such as for example, a degreasing section 5, a lining section 6 possibly connected to an annealing oven, a skin-pass roll stand 7, a temper rolling facility 8 and a reeling plant 44. The assembly is placed downstream the shears 43, parallel to the first reeling plant 42.

The lining section 6 may realise, for example, conventional quenching galvanisation, electro-galvanisation or any other lining. It is also possible to use simply a continuous annealing oven for the production of annealed and temper-rolled or skin-passed bare metal sheets.

Thanks to the operating flexibility of the coupled line according to the invention and, in particular, the possibility of slowing the band down to very low speed, it is possible, downstream the rolling section 3, to subject the rolled band, continuously, to these different treatments. In particular, the rolling speed can be adapted to the speed of the galvanisation facility that is linked to the format of the metal sheet to be lined and to the weight of the lining requested. It is then not necessary to provide an accumulator between the rolling section 3 and the finishing section.

In such an installation, changing the roll can be programmed by providing a set of coils to be lined that do not require any rolling, in order to change the rolls during that period.

To this end, a junction enables to direct the band, either toward the lining facility, up to the reeling plant 44, or directly, toward the reeling plant 42.

The reference signs inserted after the technical features mentioned in the claims solely aim at facilitating the understanding of the said and do not limit their extent whatsoever.

What is claimed is:

1. A method for continuous cold rolling of a metal band product wound into coils by running the band through a continuous line installation comprising successively, in the running direction of the band:

an inlet section comprising at least means for unwinding coils after one another and a device for welding the downstream extremity, in the running direction, of a first coil with the upstream extremity of a following coil in order to form a continuous band, a treatment section by running the band in contact with a treatment fluid whose composition is set for pickling the band, a cold rolling section with adjustment of the rolling conditions in order to obtain a requested quality of the band, an outlet section comprising at least one means for shearing the rolled and means for winding the said band into a coil, at least two means for accumulating a variable length of band, whereas both means are interposed, respectively, one between the inlet section and the treatment section, and the other between the treatment section and the rolling section, to allow relative variations of the running speeds in each of the said sections, characterised in that the composition of the treatment fluid is determined so that the metal of the band is not attacked during a dwelling time in the treatment section corresponding to a minimum running speed in the order of a few metres per minute, that the rolling conditions are determined so that the requested speed of the band can be maintained at minimum rolling speed that may be as low as one meter per minute and that, during all the operating phases, the running speed in the treatment section and the running speed in the rolling section remain substantially similar.

2. A rolling method according to claim 1, wherein the running speeds, respectively in the treatment section and in the rolling section, can be reduced down to minimum speed of 1–2 m/mn while maintaining the requested quality of the band.

3. A rolling method according to any of claims 1 or 2, wherein the maximum running speeds, respectively in the inlet section and in the rolling section do not exceed by more than 10% the maximum running speed in the treatment section.

4. A rolling method according to claim 1, characterised in that, during the period necessary for welding the extremities, respectively downstream and upstream extremities of two successive coils, the running of the band is stopped in the inlet section and the running speed in the treatment section is lowered to a rather small minimum value so that the length of band running through the treatment section during the welding period does not exceed a few ten metres.

5. A rolling method according to claim 4, characterised in that, during the period necessary for shearing the band, the running speed in the outlet section does not exceed 1 m/mn and the running speed in the rolling section is lowered to a rather small minimum value so that the length of band does not exceed a few ten metres.

6. A rolling method according to claim 1, characterised in that, during all the operating phases, the relative running speeds, respectively in the inlet section, the treatment section, the rolling section and the outlet section, are adjusted so that the speed difference between two successive sections during an operating phase matches the running, the fastest section, of an additional band length not exceeding a few tens of metres.

7. A rolling method according to claim 6, characterised in that, when filling the means of accumulation, the running speed in the section placed downstream said means of accumulation is adjusted to a value that is smaller by approximately 10% than the speed in the section placed upstream.

8. A rolling method according to claim 7, characterised in that an average yearly production ranging between 300,000 and one million tons can be obtained.

9. A rolling method according to claim 8, characterised in that, after cold rolling, the rolled band is subjected to at least one finishing treatment such as lining with continuous annealing.

10. An installation for the manufacture of a metal band comprising successively, along the running direction of the band:

an inlet section comprising at least means for unwinding coils after one another and a device for welding the downstream extremity, in the running direction, of a first coil with the upstream extremity of a following coil in order to form a continuous band, a treatment section by running the band in contact with a treatment fluid whose composition is set for pickling the band, a cold rolling section with adjustment of the rolling conditions in order to obtain a requested quality of the band, an outlet section comprising at least one means for shearing the rolled and means for winding the said band into a coil, at least two means for accumulating a variable length of band, whereas both means are interposed, respectively, one between the inlet section and the treatment section, and the other between the treatment section and the rolling section, to allow relative variations of the running speeds in each of the said sections, characterised in that the accumulation means have a capacity limited to a few ten metres, that the rolling section comprises no more than three stands, that the shearing device comprises fixed type shears cutting the band at a speed not exceeding 1 m/mn and that the winding means comprise a single reeling plant.

11. An installation according to claim 10, characterised in that the tensioning means of the band are interposed, respectively at the inlet and the outlet of the treatment section.

12. An installation according to claim 10, characterised in that the accumulation means have a capacity limited to twice the thirtieth of the maximum value of the running speed in the treatment section.

13. An installation according to one of claims 10 to 12, characterised in that, for the production of steel bands with minimum thickness ranging from 0.4 to 0.5 mm, roll stands are fitted with working rolls whose diameter ranges between 300 and 350 mm.

14. An installation according to one of claims 10 to 12, characterised in that, for the production of steel bands with minimum thickness ranging from 0.2 to 0.25 mm, roll stands are fitted with working rolls whose diameter does not exceed 150 mm.

15. An installation according to one of claims 10 to 12, characterised in that at least one roll stand is fitted with controlled deformation back-up rolls.

16. An installation according to claim 10, characterised in that at least one roll stand is of the sexto type with lateral back-up means for the working rolls.

17. An installation according to claim 10, characterized in that it comprises at least one continuous lining facility placed on the path of the band downstream the rolling section and followed by means for winding the band.

18. An installation according to claim 17, characterised in that the continuous lining facility operates at a running speed similar to the speed of the band at the outlet of the rolling section.

19. An installation according to claim 18, characterised in that the lining facility is a galvanising facility.

20. An installation according to one of claims 18 and 19, characterised in that it comprises a continuous annealing facility.

* * * * *